US005789856A

United States Patent [19]

Itoh et al.

[11] Patent Number: 5,789,856

[45] Date of Patent: Aug. 4, 1998

[54] FLUORESCENT DISPLAY DEVICE WITH BLUE FILTER

[75] Inventors: Shigeo Itoh; Hitoshi Toki; Tatsuo Yamaura; Yukio Ogawa; Teruo Watanabe, all of Mobara, Japan

[73] Assignee: Futaba Denshi Kogyo K.K., Mobara, Japan

[21] Appl. No.: 379,990

[22] Filed: Jan. 27, 1995

[30] Foreign Application Priority Data

Jan. 28, 1994 [JP] Japan ..... 6-008731

[51] Int. Cl.[6] ..... H01J 1/62

[52] U.S. Cl. ..... 313/495; 313/496; 313/467; 313/112

[58] Field of Search ..... 313/495, 496, 313/497, 467, 468, 461, 503, 505, 507, 506, 509, 112, 466, 474, 309, 336, 351

[56] References Cited

U.S. PATENT DOCUMENTS

| | | | |
|---|---|---|---|
| 5,063,327 | 11/1991 | Brodie | 313/495 |
| 5,099,172 | 3/1992 | Taguchi | 313/503 |
| 5,239,228 | 8/1993 | Taniguchi | 313/112 |
| 5,277,841 | 1/1994 | Jeong | 250/301.4 H |
| 5,394,055 | 2/1995 | Tono | 313/467 |
| 5,543,685 | 8/1996 | Okamoto et al. | 313/112 |
| 5,559,397 | 9/1996 | Tsuruoka et al. | 313/112 |
| 5,578,899 | 11/1996 | Haven et al. | 313/422 |
| 5,594,305 | 1/1997 | Primm et al. | 315/169.3 |

*Primary Examiner*—Sandra L. O'Shea
*Assistant Examiner*—Vip Patel
*Attorney, Agent, or Firm*—Oblon, Spivak, McClelland, Maier & Neustadt, P.C.

[57] ABSTRACT

A field emission type fluorescent display device capable of carrying out luminous display with increased reliability at an anode voltage 200V to 1000V and providing a desired luminous color by means of a filter. The fluorescent display device includes a luminous display section consisting of three display elements. The display elements include filters of red, green and blue colors on which light-permeable anode conductors are deposited, respectively. Then, the anode conductors have phosphors of the same colors as the filters deposited thereon, respectively. The blue phosphor is made of ZnO:Zn substantially containing a blue color component. Thus, a combination of the blue filter and phosphor provides light of a blue color with increased efficiency.

10 Claims, 5 Drawing Sheets

FIG.6A
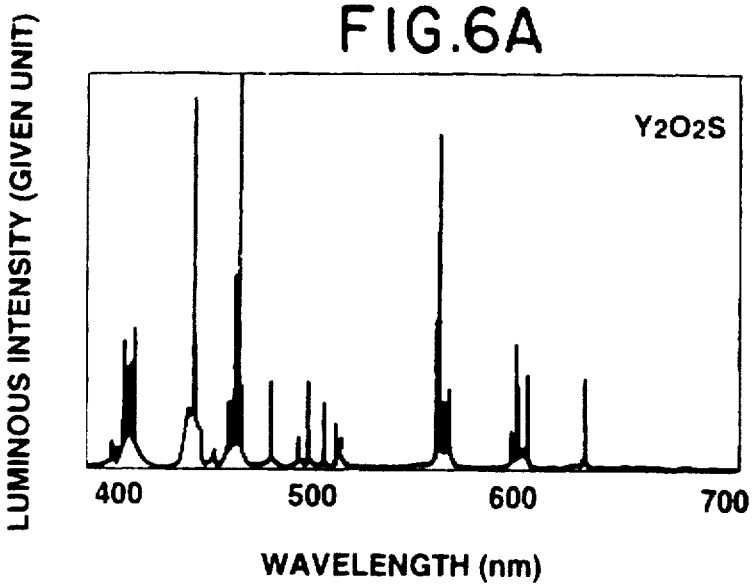
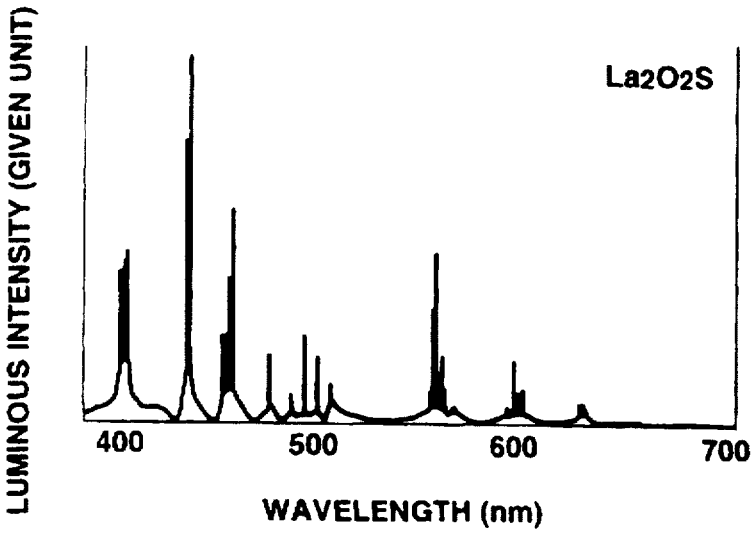
FIG.6B

FIG.7A
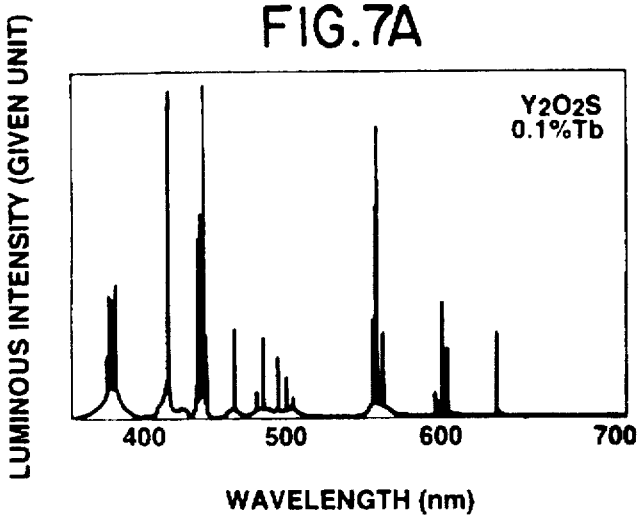
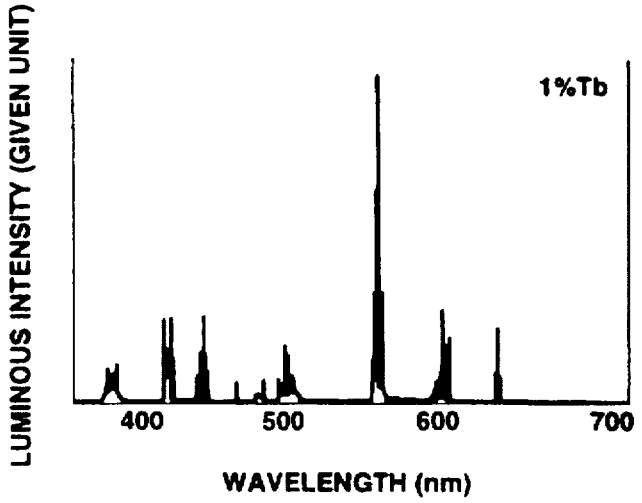
FIG.7B
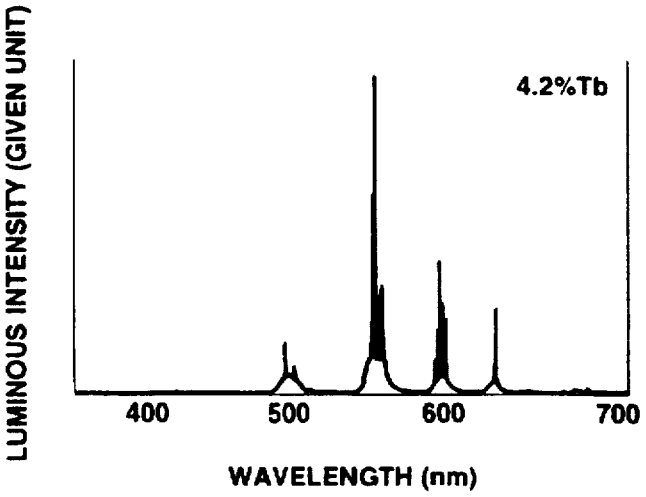
FIG.7C

FLUORESCENT DISPLAY DEVICE WITH BLUE FILTER

BACKGROUND OF THE INVENTION

This invention relates to a fluorescent display device adapted to carry out luminous display by impinging electrons on phosphors arranged in a display section to excite the phosphors for luminescence, and more particularly to a field emission type fluorescent display device including field emission cathodes (hereinafter also referred to as "FECs") acting as an electron source and adapted to carry out color luminous display by means of a filter.

In general, a fluorescent display device which has been conventionally used for color luminous display includes filamentary cathodes functioning as an electron source and anodes having low-velocity electron excited phosphors deposited thereon. The filamentary cathodes are fed with electricity, to thereby be heated to a degree sufficient to emit thermions therefrom. The anodes have anode voltage of 100V or less applied thereto. The thermions emitted from the filamentary cathodes are impinged on the low-velocity electron excited phosphors, resulting in luminous display being carried out.

Recently, a display device in which FECs which are a kind of cold cathode are used as an electron source is conventionally known in the art as disclosed in Japanese Patent Application Laid-Open Publication No. 221783/1986. Also, Japanese Patent Application Laid-Open Publication No 61946/1990 discloses a color graphic display device including FECs acting as an electron source, wherein electrons emitted from the FECs are impinged on color phosphors, to thereby cause the phosphors to emit light, resulting in color luminous display being provided.

The FECs incorporated in the display device disclosed in Japanese Patent Application Laid-Open Publication No. 61946/1990 are of the Spindt-type. More particularly, the display device is so constructed that gate electrodes are arranged through an insulating layer on a cathode conductor provided on an inner surface of a substrate. The gate electrodes and insulating layer are formed with common through-holes extending to the cathode conductors in which emitters of a conical shape are positioned while being arranged on the cathode conductor.

An anode substrate is formed on an inner surface thereof opposite to the FECs with a plurality of strip-like anode conductors at predetermined intervals by etching of ITO. The anode conductors adjacent to each other have three kinds of phosphors R, G and B of red, green and blue luminous colors alternately deposited thereon in a repeated manner, respectively, resulting in providing anodes acting as a luminous display section. The phosphor R of a red luminous color is $Y_2O_2S$:Eu, the phosphor G of a green luminous color is ZnS:Cu, and the phosphor B of a blue luminous color is ZnS:Ag.

In the display device including the FECs, an anode voltage as high as hundreds of volts is applied to the anode conductors, so that electrons emitted from the FECs have high energy as compared with low-velocity electron beams emitted from filamentary cathodes. Thus, the electrons tend to decompose the phosphors due to impingement of the electrons thereon, as compared with the low-velocity electron beams. As will be noted from the above, the phosphors incorporated in the display device each are a sulfide containing sulfur (S), so that decomposition of each of the phosphors due to impingement of the electrons thereon produces sulfides such as $SO_2$ and the like, which are then scattered. The sulfides thus scattered are then deposited onto emitters of the FECs, resulting in the emitters being contaminated by the sulfides, leading to problems such as deterioration in emission characteristics and durability of the FECs.

Also, the ZnS:Ag phosphor of a blue luminous color is decreased in resistance to temperatures. More particularly, it begins thermal decomposition at a temperature of 400° to 500° C. in a vacuum and sublimates at 800° C. Manufacturing of the fluorescent display device includes the step of heating the device to 500° C. or more, so that the phosphor falls to exhibit desired performance.

Further, when the FECs are used as an electron source as in the conventional fluorescent display device described above, an anode voltage as high as hundreds of volts is applied to the anode conductors. This causes electrons to be substantially accelerated, so that the electrons are increased in velocity, to thereby deeply enter each of the phosphors. This causes secondary electrons produced in an interior of the phosphor to be highly difficult to get out to a surface of the phosphor, so that luminescence of the phosphor is carried out only on the surface, resulting in generation of heat from the phosphor concentratedly taking place only on the surface. This causes a decrease in luminance of the phosphor and deterioration in durability and characteristics thereof. Thus, the phosphors and particularly that of a blue luminous color fail to exhibit satisfactory initial luminance and durability.

SUMMARY OF THE INVENTION

The present invention has been made in view of the foregoing disadvantages of the prior art.

Accordingly, it is an object of the present invention to provide a field emission type fluorescent display device which is capable of carrying out color luminous display of sufficient luminance even at an anode voltage as high as 200V to 1000V.

It is another object of the present invention to provide a field emission type fluorescent display device which is capable of exhibiting significantly increased durability or life characteristics.

It is a further object of the present invention to provide a field emission type fluorescent display device which is capable of minimizing a deterioration in luminance.

It is still another object of the present invention to provide a field emission type fluorescent display device which is capable of exhibiting increased reliability.

In accordance with the present invention, a field emission type fluorescent display device is provided. The fluorescent display device includes field emission cathodes acting as an electron source and a luminous display section for emitting light due to impingement of electrons emitted from the field emission cathodes thereon. The luminous display section includes light-permeable electrodes having an anode voltage of 200V to 1000V applied thereto, phosphors deposited on the light-permeable electrodes, and filters each for permitting color display of luminescence of each of the phosphors to be carried out.

In a preferred embodiment of the present invention, the phosphors each are made of a material other than a ZnS or ZnCdS material.

In a preferred embodiment of the present invention, the luminous display section includes three kinds of display elements consisting of a red display element of a red luminous color, a green display element of a green luminous color and a blue display element of a blue luminous color.

Also, in accordance with the present invention, a field emission type fluorescent display device is provided. The fluorescent display device includes an envelope, field emission cathodes arranged in the envelope, and a luminous display section arranged in the envelope for emitting light due to impingement of electrons emitted from the field emission cathodes thereon. The luminous display section includes a filter arranged on an inner surface of the envelope, a light-permeable electrode deposited on the filter and having an anode voltage of 200V to 1000V applied thereto, and a phosphor deposited on the light-permeable electrode.

In a preferred embodiment of the present invention, the filter is a blue filter and the phosphor is ZnO:Zn.

In a preferred embodiment of the present invention, the phosphor is $Ln_2O_2S$:Tb (Tb=0.01 to 1 at %, Ln=Y, La).

In a preferred embodiment of the present invention, the phosphor is $Y_2SiO_5$:Ce.

In a preferred embodiment of the present invention, the blue filter is made of a heat resistant material containing fine particles of an inorganic pigment.

Further, in accordance with the present invention, a field emission type fluorescent display device is provided. The fluorescent display device includes an envelope, field emission cathodes arranged in the envelope, and a luminous display section arranged in the envelope for for emitting light due to impingement of electrons emitted from the field emission cathodes thereon. The luminous display section includes a filter arranged on an outer surface of the envelope, a light-permeable electrode arranged on an inner surface of the envelope and having an anode voltage of 200V to 1000V applied thereto, and a phosphor deposited on the light-permeable electrode.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 6 is a spectral diagram showing a spectral distribution of luminescence of a $La_2O_2S$:0.1% Tb at a room temperature; and FIG. 7 is a chart showing dependency of an emission spectrum of a $Y_2O_2S$:Tb phosphor at a room temperature on a concentration of Tb.

DETAILED DESCRIPTION OF THE PREFERRED EMBODIMENTS

Now, a field emission type fluorescent display device according to the present invention will be described hereinafter with reference to the accompanying drawings.

The following embodiments each are directed to a field emission type fluorescent display device exhibiting increased reliability under driving conditions that an anode voltage is set to be 200V to 1000V. Thus, the embodiments each incorporate therein a phosphor exhibiting satisfactory resistance to temperatures and decreased in resistance, as well as a filter, to thereby obtain luminous colors desired.

Figure 1:
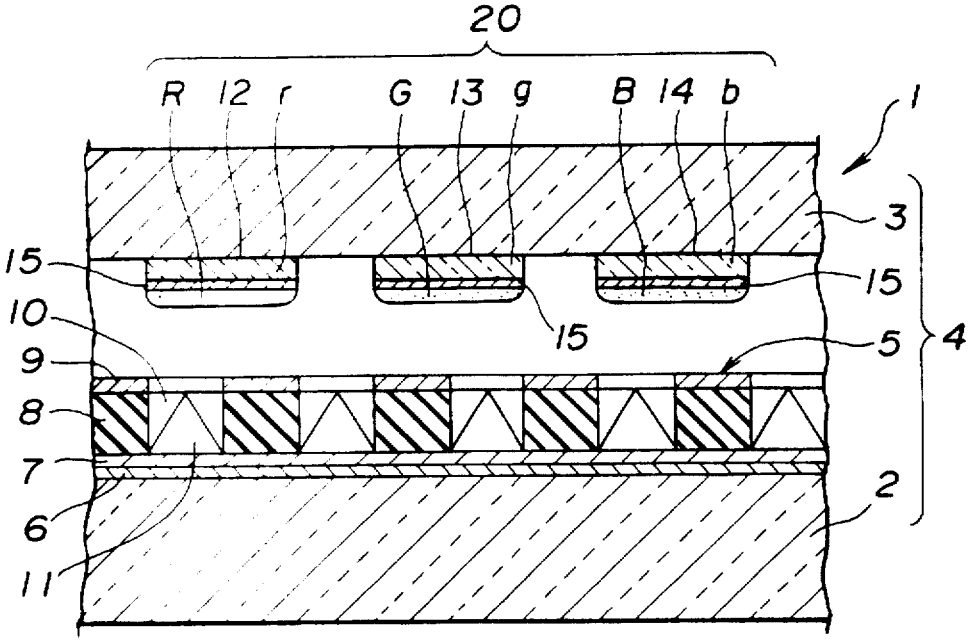
FIG. 1 is a fragmentary sectional view showing a first embodiment of a field emission type fluorescent display device according to the present invention.
Figure 2:
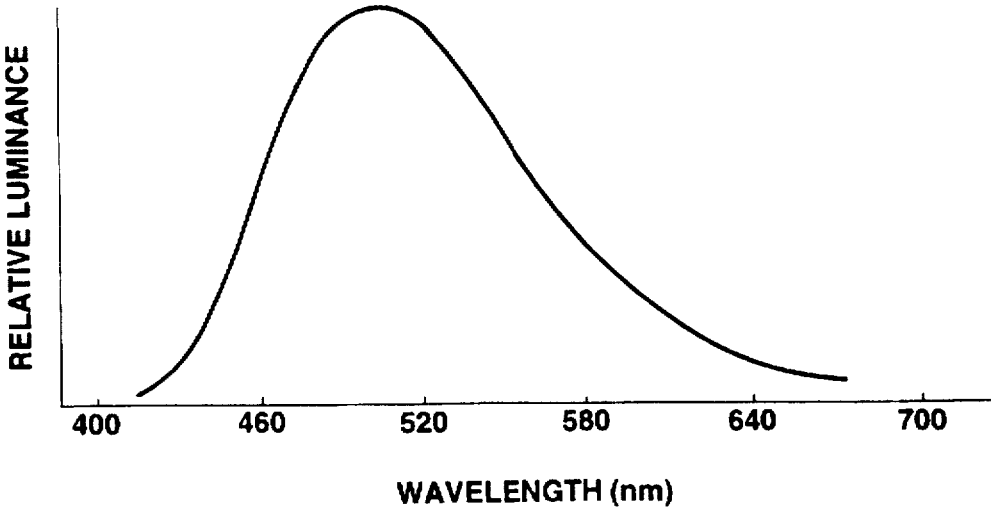
FIG. 2 is a graphical representation showing a spectral distribution of luminescence of a ZnO:Zn phosphor incorporated in the fluorescent display device of FIG. 1.
Figure 3:
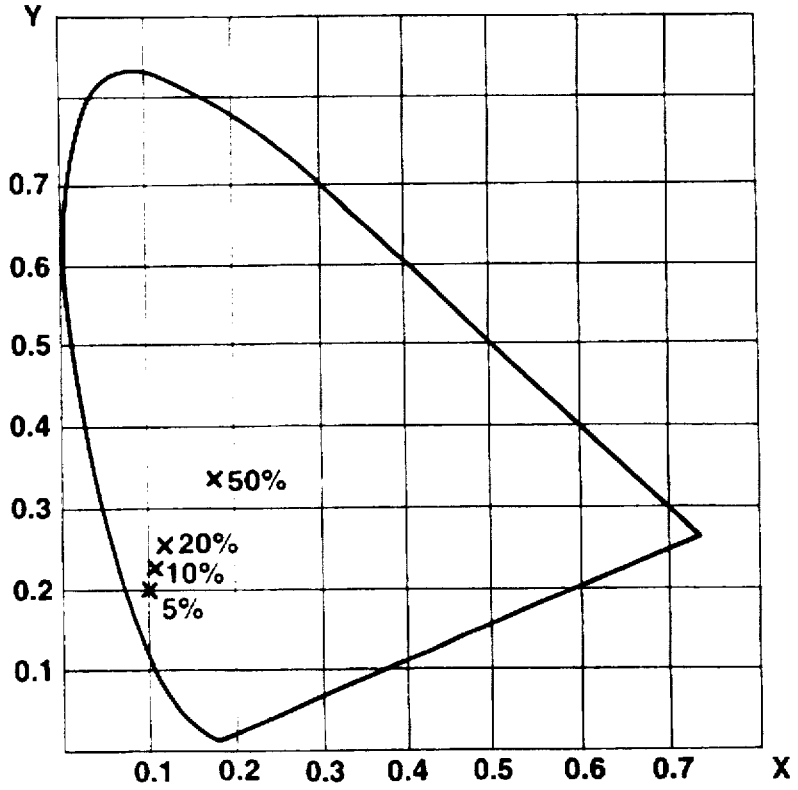
FIG. 3 is a CIE chromaticity diagram showing color purity of a blue filter incorporated in the fluorescent display device of FIG. 1 and its transmittance.

Referring first to FIGS. 1 to 3, a first embodiment of a field emission type fluorescent device according to the present invention is illustrated. A field emission type fluorescent display device of the illustrated embodiment generally designated at reference numeral 1 includes a first substrate 2 and a second substrate 3 arranged so as to be opposite to each other at a predetermined interval. The substrates 2 and 3 are sealedly joined at an outer periphery thereof to each other by means of a sealing material.(not shown) acting also as a spacer therebetween, to thereby define an airtight envelope 4 in cooperation with the sealing material, which envelope 4 is then evacuated to a high vacuum.

The first substrate 2 is provided on an inner surface thereof with FECs 5 acting as an electron source. More particularly, the first substrate 2 has a cathode conductor 6 provided on the inner surface thereof, on which a resistive layer 7 is formed. Then, the resistive layer 7 is provided thereon through an insulating layer 8 with a gate electrode 9. The gate electrode 9 and insulating layer 8 are formed with a plurality of common through-holes 10 extending to the resistive layer 7. The through-holes 10 each are provided therein with an emitter 11 of a conical shape while being arranged on the resistive layer 7.

The second substrate 3 is provided on an inner surface thereof opposite to the FECs 5 with a luminous display section 20 including three kinds of display elements repeatedly arranged in an alternate manner. The luminous display section 20 includes a display element 12 of a red luminous color or a red display element 12, a display element 13 of a green luminous color or a green display element 13, and a display element 14 of a blue luminous color or blue display element 14. More particularly, the second substrate 3 is provided thereon with three kind of transparent red, green and blue filters r, g and b which permit light of a red luminous color, that of a green luminous color and that of a blue luminous color to permeate therethrough, respectively, which are arranged in a manner to be spaced from each other at predetermined intervals and alternately arranged in a repeated manner. The red, green and red filters r, g and b each have an anode conductor 15 acting as a transparent electrode deposited thereon. The anode conductors 15 each have a phosphor of a luminous color identical with a color of light permeating through the corresponding filter deposited thereon. Thus, three kinds of phosphors R, G and B emitting red, green and blue luminous colors are deposited on the anode conductors 15 arranged on the filters r, g and b capable of transmitting red, green and blue colors therethrough, respectively.

In the illustrated embodiment, the first substrate 2 and second substrate 3 each are made of glass, the cathode conductor 6, gate electrode 9 and emitters 11 are made of Nb, the resistive layer 7 is made of Si doped with P or B, the insulating layer 8 is made of $SiO_2$, and the anode conductors 15 are made of ITO. Each of the anode conductors 15 is required to be transparent, therefore, it maybe made of a light-permeable and conductive thin film, a thin film of Al or the like constructed into a mesh-like or stripe-like light-permeable structure, or the like.

In the illustrated embodiment, a phosphor provided in the display element 14 is ZnO:Zn. The ZnO:Zn phosphor generally exhibits luminescence sufficient to be put to practical use when it is excited under an anode voltage of about 200V to 1000V. The ZnO:Zn phosphor includes components of wavelengths extending from about 400 nm to about 650 nm and emits light of luminous color visually observed as a bluish green color. Luminescence of the ZnO:Zn phosphor predominantly contains a blue color component of 500 nm or below, so that a combination of the ZnO:Zn phosphor with the blue filter b provides light of a blue luminous color with increased efficiency.

The field emission type fluorescent display device 1 of the illustrated embodiment was driven under the conditions that an anode voltage, an anode current and a duty ratio are set to be 400V, 75 $mA_{p-p}$ $cm^2$ and 1/120, respectively. After the ZnO:Zn phosphor of the blue display element 14 was subject to excitation for 1000 hours continuously, luminance retention of the phosphor was 100%. Thus, a reduction in initial luminance of the phosphor was not observed.

Now, a procedure of preparation of the blue filter b will be described hereinafter. In the illustrated embodiment, a $CoO.nAl_2O_3$ pigment may be used as an inorganic pigment. Powder of a low-melting frit glass is added as a binder to the pigment in the form of fine powder of 1 μm or less in size, resulting in a mixture being prepared, which is then dispersed in a solvent, leading to a filter forming dispersion. Subsequently, the dispersion is applied to the inner surface of the second substrate 3 in a predetermined pattern by slurry techniques or the like and then subject to calcination at about 500° C., to thereby prepare the blue filter b.

The blue filter b incorporated in the illustrated embodiment, as described above, is made of the inorganic pigment and frit glass, to thereby exhibit resistance to temperatures even in a sealing step at about 500° C. in manufacturing of the fluorescent display device. Filtration of light of the ZnO:Zn phosphor through the filter b permits light of only a blue luminous color to permeate therethrough and the other color components to be absorbed thereby.

In the illustrated embodiment, the blue luminous element 14 provides blue light of luminance of about 20% based on luminance of the ZnO:Zn phosphor obtained when it is free of the filter b. Further, use of a filter of increased blue purity leads to a decrease in transmittance. FIG. 3 is a CIE chromaticity diagram, wherein points each indicate a particular color. FIG. 3 indicates that an increase in blue purity leads to a decrease in transmittance.

The phosphors G and R of a non sulfide system provided for the green and red display elements 13 and 12 which respectively exhibit green (G) and red (R) luminous colors in the illustrated are listed by way of example in TABLE 1. The phosphors exhibit luminous characteristics sufficient to be put to practical use when they are excited under an anode voltage of about 200V to 1000V in the fluorescent display device.

TABLE 1

| Phosphor | Luminous Color | Luminance Retention After 1000 Hr (%) | Eg |
|---|---|---|---|
| $Zn(Ga, Al)_2O_4$:Mn | Green | 100 | 4.5 |
| $SnO_2$:Eu | Red | 100 | 3.4 |
| $La_2O_2S$:Tb | Green | 100 | 4.4 |
| $Gd_2O_2S$:Tb | Green | 90–100 | 4.5 |
| $Y_2O_2S$:Tb | Green | 70–90 | 4.6 |
| $La_2O_2S$:Eu | Red | 100 | 4.4 |
| $Gd_2O_2S$:Eu | Red | 90–100 | 4.5 |
| $Y_2O_2S$:Eu | Red | 70–90 | 4.6 |

TABLE 1-continued

| Phosphor | Luminous Color | Luminance Retention After 1000 Hr (%) | Eg |
|---|---|---|---|
| $Gd_2O_3$:Eu | Red | 70–90 | 5.5 |
| $Y_2O_3$:Eu | Red | 50–70 | 5.6 |
| $Y_2O_3$:Eu + $In_2O_3$ | Red | 40–50 | 5.6 |
| $Y_2O_2S$:Tb + $In_2O_3$ | Green | 50–60 | 4.5 |
| ZnO:Zn | Bluish Green | 100 | 3.2 |
| $Y_2SiO_5$:Ce | Bluish White | 75 | 5.5 |

The field emission type fluorescent display device of the illustrated embodiment was driven for 1000 hours for luminous display. As a result, the phosphors listed in TABLE 1 each exhibited luminance retention as indicated in the third column of TABLE 1. Conditions for the test of continuous luminescence were identical with those for the ZnO:Zn of the blue display element 14 described above.

The results in TABLE 1 indicates that the red and green phosphors of which Eg is 5.6 or less and preferably 5.5 or less each are improved in life characteristics when it is free of a conductive material such as $In_2O_3$ or the like.

The filters r and g incorporated in the red and green display elements 12 and 13 in the illustrated embodiment each contain an inorganic pigment like the blue filter b and is prepared according to a procedure similar that for the blue filter b, resulting in exhibiting resistance to heat or temperatures sufficient to endure the sealing step in manufacturing of the field emission type fluorescent display device 1.

The red and green display elements 12 and 13 in the illustrated embodiment include the phosphors of red and green luminous colors, respectively, as shown in TABLE 1, thus, it is not necessarily required to arrange filters of the same colors. However, use of filters of the same colors permits purity of colors displayed to be increased. It would be considered that the phosphors are generally white, to thereby render discrimination between luminescence of the phosphors and non-luminescence thereof substantially difficult when the display elements are exposed to external light. On the contrary, incorporation of the filters of the same colors as the luminous colors of the phosphors in the fluorescent display device of the illustrated embodiment enhances contrast of the luminous display, to thereby improve visibility of the display. Such an improvement in visibility due to an increase in contrast can be likewise accomplished in connection with the blue display element including the blue filter and ZnO:Zn phosphor.

Figure 4:
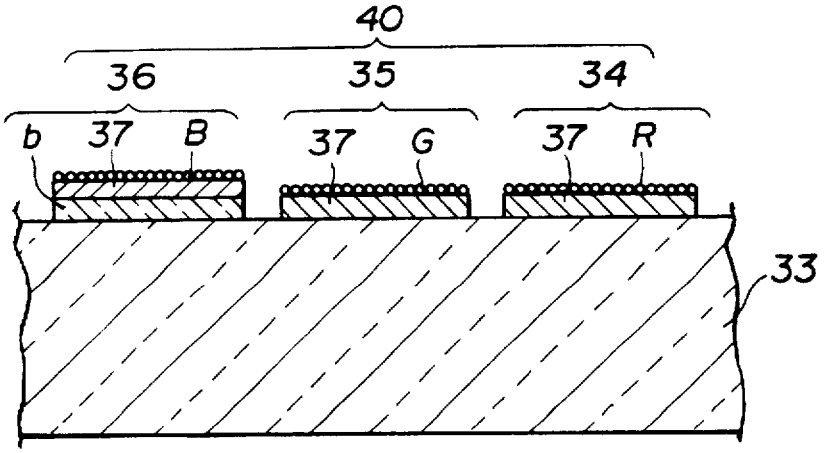
FIG. 4 is a fragmentary sectional view showing a second embodiment of a field emission type fluorescent display device according to the present invention.

Now, a second embodiment of a field emission type fluorescent display device of the present invention will be described hereinafter with reference to FIG. 4, which is a sectional view showing a second substrate 33 of a field emission type fluorescent display device of the second embodiment. A first substrate including FECs may be constructed in substantially the same manner as that of the first embodiment described above.

In the second embodiment, of three kinds of display elements or a red display element 34, a green display element 35 and a blue display element 36 which constitute a luminous display section 40, only the blue display element 36 includes a filter b which permits light of a blue color to permeate therethrough. The filter b of the blue display element 36 and a phosphor B are substantially the same as those of the first embodiment. The red display element 34 includes an anode conductor 37 made of ITO and serving as a light-permeable electrode and a phosphor R of a red luminous color deposited on the anode conductor 37.

Likewise, the green display element 35 includes an anode conductor 37 and a phosphor G of a green luminous color deposited on the anode conductor 37. The phosphors R and G likewise have characteristics as shown in TABLE 1.

A first example of the fluorescent display device of the illustrated embodiment was practiced in such a manner that the phosphor G of a green luminous color was made of $Zn(Ga, Al)_2O_4$:Mn (Al: 0.1 to 30 mol based on Ga) and the phosphor R of a red luminous color is made of $La_2O_2S$:Eu, followed by coating of alumina on a surface of the phosphor while setting transmittance of the blue filter b at 5%.

The field emission type fluorescent display device including the display elements 34, 35 and 36 respectively including the phosphors described above was constructed. For this purpose, the anode conductor 37 exhibiting light permeability were formed on each of two positions on a light-permeable substrate 33, on which the phosphors R and G were deposited in the form of a layer. Then, the blue filter b was formed in proximity to the red and green display elements 34 and 35 and then formed thereon with the light-permeable anode conductor 37 and blue phosphor B in order by lamination. Formation of the phosphor layers was carried out by depositing each of the phosphors on a predetermined position by slurry techniques and then subject to calcination, to thereby remove a binder therefrom.

Then, an envelope including the substrate 33 as a part thereof was formed in a manner to render the luminous display section 40 opposite to an electron source at a predetermined interval.

The fluorescent display device thus constructed was then driven at an anode voltage of 400V and a duty ratio of 1/240 for luminous display desired, to thereby evaluate luminance of each of the phosphors. The blue, green and red phosphors were 50 $cd/m_2$, 200 $cd/m_2$ and 100 $cd/m_2$ in luminance, respectively.

A second example of the fluorescent display device of the illustrated embodiment was practiced in such a manner that the phosphor G of a green luminous color is made of $La_2O_2S$:Tb, followed by coating of alumina on a surface of the phosphor and the phosphor R of a red luminous color is made of $Y_2O_2S$:Eu while setting transmittance of the blue filter b at 5%.

A field emission type fluorescent display device was constructed as in the first example and then subject to a lighting test. As a result, it was found that the blue, green and red phosphors were 100 $cd/m_2$, 300 $cd/m_2$ and 150 $cd/m_2$ in luminance, respectively.

A third example of the fluorescent display device of the illustrated embodiment was practiced under substantially the same conditions as the first example described above, except that the phosphor R of a red luminous color is made of $Gd_2O_2$:Eu. The phosphors exhibited the same luminance except that the red phosphor was 150 $cd/m^2$ in luminance.

Results similar to the above were obtained when the phosphors were made of solid solution such as $(Y, Gd)_2O_2S$:Eu, $(La, Gd)_2O_2S$:Eu or the like. Also, coating of alumina on the phosphors or addition of a material of satisfactory thermal conductivity to each of the phosphors or the like as described above likewise contributes to an improvement in luminous characteristics.

Use of the ZnO:Zn phosphor in the above-described examples of the present invention permits a blue luminous color component of light to exhibit increased luminance.

Also, the ZnO:Zn phosphor may be replaced with a $Ln_2O_2S$:Tb (Tb=0.01 to 1 at %, Ln=Y, La) exhibiting a bluish white luminous color as shown in FIG. 6. An anode having the phosphor deposited thereon was driven for luminescence under conditions that an anode voltage, an anode current and a duty ratio were set to be 400V, 75 $mA/cm^2$ and 1/120, respectively; resulting in light being emitted therefrom. Then, the light was allowed to permeate through a filter which exhibits blue transmittance of 50% or permits 50% of a blue luminous color to permeate therethrough. As a result, it was found that luminance of a blue luminous color component of light emitted from the phosphor was measured to be 40 $cd/m^2$. Also, luminance retention after subjecting the phosphor to continuous lighting for 1000 hours was measured to be 80%. A concentration of Tb is preferably 0.01 to 1 at %. The concentration above 1 at % causes the phosphor to exhibit a green color component excessive to a degree sufficient to cause it to be unsuitable for a blue luminous color.

Figure 5:
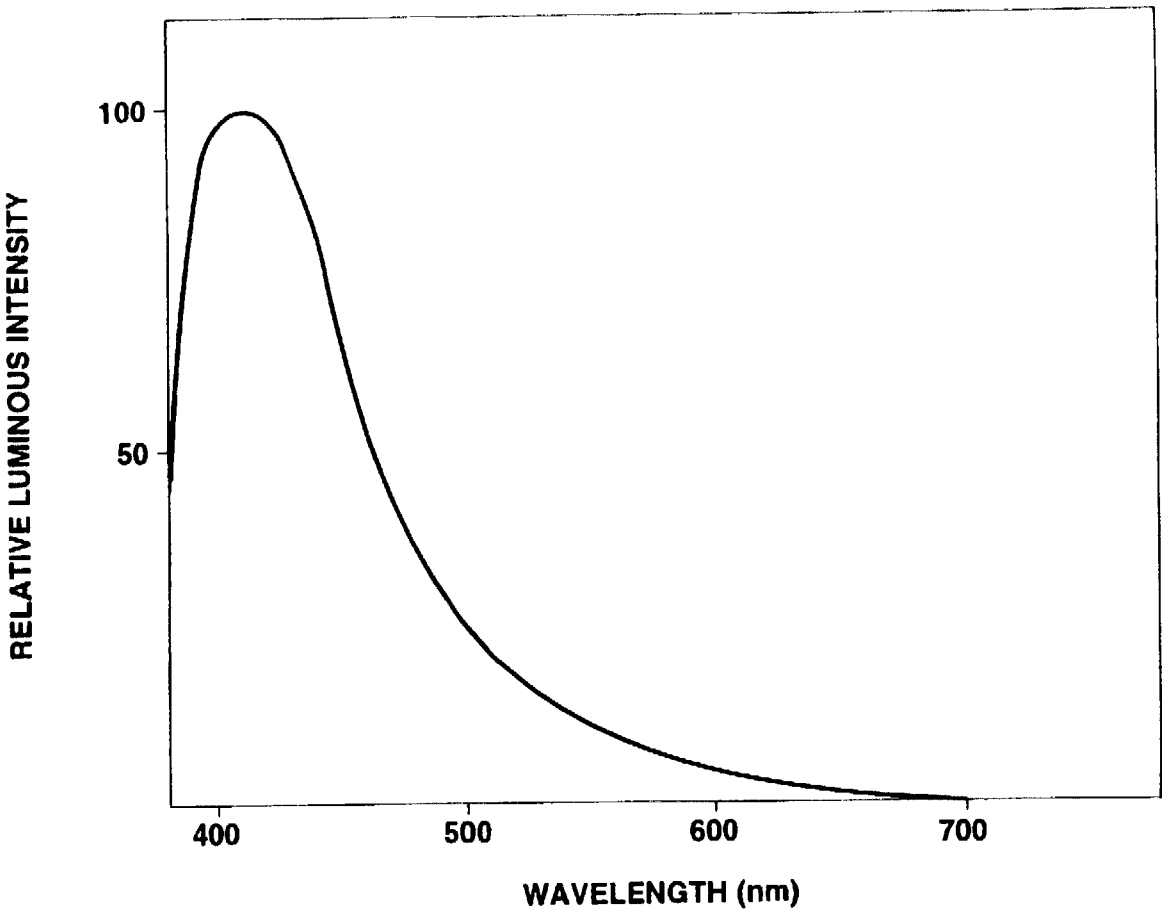
FIG. 5 is a graphical representation showing a spectral distribution of luminescence of a $Y_2SiO_5$:Ce phosphor.

Also, substantially the same evaluation was carried out with respect to such a $Y_2SiO_5$:Ce phosphor as shown in FIG. 5. As a result, luminance of a blue luminous color component of light emitted from the phosphor was 60 $cd/m^2$ and luminance retention after continuous lighting for 1000 hours was 75%. Thus, it was found that it is suitable for use as a phosphor for a blue luminous color.

The phosphors used in the above-described examples of the present invention each are free of any sulfide, so that deterioration in emission characteristics of the electron source due to the contamination by sulfide is effectively prevented.

Further, the phosphor used in each of the examples is hard to be decomposed and is not caused to sublime at a temperature of about 800° C. or below as seen in ZnS. Also, the phosphors each exhibit electrical conductivity at a driving voltage of 200V to 1000V, to thereby permit secondary electrons produced in the phosphor to get out to a surface thereof. This prevents generation of heat from being concentratedly carried out on the surface of the phosphor, to thereby minimize a decrease in luminance of the phosphor and deterioration in life characteristics thereof.

Thus, it will be noted that the illustrated embodiment realizes a field emission type fluorescent display device which permits luminance of a blue luminous color component of emitted light to be substantially increased at an anode voltage of hundreds of volts.

As can be seen from the foregoing, the field emission type fluorescent display device of the present invention carries out satisfactory color luminous display of satisfactory luminance at an anode voltage of 200V to 1000V, permits life characteristics thereof to be highly improved and prevents deterioration in luminance.

While preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

a vacuum envelope including a first substrate and a second substrate arranged so as to be opposite to each other at a predetermined interval;

field emission cathodes arranged on said first substrate; and a luminous display section arranged on said second substrate for emitting light due to impingement of electrons emitted from said field emission cathodes;

said luminous display section comprising light-permeable electrodes having three different phosphors for effecting luminous display, of red green and blue colors deposited on said light-permeable electrodes and a blue filter for permitting color display of blue luminescence of said phosphor through said light-permeable electrodes on which said phosphor for effecting luminous display of blue color is deposited.

2. A fluorescent display device as defined in claim 1, wherein said filter is made of heat resistant material containing fine particles of an inorganic pigment.

3. The fluorescent display device of claim 1, wherein said cathodes comprise a conical electron emitter.

4. A fluorescent display device as defined in claim 1, wherein said phosphor for effecting blue luminous display is selected from the group consisting of ZnO:Zn, $Ln_2O_2S$:Tb where Ln is Y, La and $Y_2Si$:$O_5$:Ce.

5. A fluorescent display device as defined in claim 1, wherein said phosphor for effecting red luminous display is selected from the group consisting of $SnO_2$:Eu, $La_2O_2S$:Eu, $Gd_2O_2S$:Eu, $Y_2O_2S$:Eu, $Gd_2O_3$:Eu, $Y_2O_3$:Eu and $Y_2O_3$:Eu+$In_2O_3$.

6. A fluorescent display device as defined in claim 1, wherein said phosphor for effecting green luminous display is selected from the group consisting of $Zn(Ga,Al)_2O_4$:Mn, $La_2O_2S$:Tb, $Gd_2O_2S$:Tb, $Y_2O_2S$:Tb and $Y_2O_2S$:Tb+$In_2O_3$.

7. A fluorescent display device as defined in claim 5, wherein said luminous display section further comprises a red filter.

8. A fluorescent display device as defined in claim 6, wherein said luminous display section further comprises a green filter.

9. A fluorescent display device as defined in claim 1, wherein said phosphors for effecting red and green luminous display are selected from the group consisting of $SnO_2$:Eu, $La_2O_2S$:Eu, $Gd_2O_2S$:Eu, $Y_2O_2S$:Eu, $Gd_2O_3$:Eu, $Y_2O_3$:Eu, $Y_2O_3$:Eu+$In_2O_3$, $Zn(Ga,Al)_2O_4$:Mn, $La_2O_2S$:Tb, $Gd_2O_2S$:Tb, $Y_2O_2S$:Tb and $Y_2O_2S$:Tb+$In_2O_3$.

10. A fluorescent display device as defined in claim 9, wherein said luminous display section further comprises green and red filters.

* * * * *